United States Patent [19]

Shimmura et al.

[11] 4,401,094

[45] Aug. 30, 1983

[54] STARTING SYSTEM OF CARBURETORS FOR MULTIPLE KINDS OF FUELS

[75] Inventors: Shuzaburo Shimmura, Shizuoka; Tokuichi Hakamata, Hamamatsu; Masahiro Takemoto, Iwata, all of Japan

[73] Assignee: Yamaha Hatsudoki Kabushiki Kaisha, Iwata, Japan

[21] Appl. No.: 253,378

[22] Filed: Apr. 13, 1981

[30] Foreign Application Priority Data

Apr. 12, 1980 [JP] Japan ..... 55-52857
Apr. 23, 1980 [JP] Japan ..... 55-48277

[51] Int. Cl.[3] ..... F02B 1/00

[52] U.S. Cl. ..... 123/576; 123/179 G; 123/180 AC; 261/18 R

[58] Field of Search ..... 123/576, 578, 179 G, 123/180 R, 180 AC; 261/18 R, 18 A, 71, 67; 137/595, 871

[56] References Cited

U.S. PATENT DOCUMENTS 1,151,793 8/1915 Jewell ..... 123/180 AC
2,142,979 1/1939 Hans ..... 261/18 R
2,311,827 2/1943 Hansen ..... 261/18 R
2,311,828 2/1943 Hansen et al. ..... 261/18 R
2,569,377 9/1951 Hans ..... 261/18 R
3,885,545 5/1975 Charron et al. ..... 123/180 R
3,934,571 1/1976 Mennesson ..... 123/180 R

FOREIGN PATENT DOCUMENTS 420715 12/1934 United Kingdom ..... 123/576

*Primary Examiner*—Charles J. Myhre
*Assistant Examiner*—E. Rollins Cross
*Attorney, Agent, or Firm*—Ernest A. Beutler

[57] ABSTRACT

Two embodiments of dual fuel systems for internal combustion engines embodying a normal running fuel and a special fuel used for only cold starting. In each embodiment an arrangement is provided for positively cutting off the flow of starting fuel when the cold starting mode is no longer required. In one embodiment this is done automatically. Each embodiment employs an arrangement for permitting cold start enrichment with either the normal running fuel or with the special starting fuel depending upon the temperature.

11 Claims, 4 Drawing Figures

STARTING SYSTEM OF CARBURETORS FOR MULTIPLE KINDS OF FUELS

BACKGROUND OF THE INVENTION

This invention relates to a carburetor for multiple kinds of fuels and more particularly to a multiple fuel system for an internal combustion engine offering improved cold starting operation.

Recently it has been proposed to operate motor vehicles on fuels other than what is commonly characterized as gasoline. For example, it has been proposed to operate vehicles on either alcohol or a mixture of alcohol and gasoline characterized as "gasohol." There are certain advantages to the use of such fuels. However, under cold starting conditions particularly at low temperatures such as temperatures lower than 15° C., the alcohol and alcohol containing fuels may present certain difficulties in connection with starting due to the difficulties in igniting these fuels at such temperatures. Therefore, it has been proposed to provide an auxiliary fuel system for such engines that incorporate pure gasoline or other petroleum based fuels for cold starting. Once the engine has started and runs only briefly through the use of these starting fuels, it is possible to switch over the running of the engine on to the normal fuel. When this is done, however, the flow of starting fuel should be ceased. Failure to do so will cause rapid depletion of the starting fuel, which is normally supplied from a tank or reservoir having a much smaller capacity than a main reservoir. Failure to do so will, of course, make it difficult or impossible to restart the engine when it is again called and the ambient temperature is below 15° C.

It is, therefore, a principal object of this invention to provide an improved multi-fuel system for an internal combustion engine.

It is another object of this invention to provide a multi-fuel system for an internal combustion engine wherein the flow of starting fuel is automatically discontinued once the cold starting operation has been completed.

In certain types of multi-fuel systems for internal combustion engines the carburetor or other charge forming device is provided with two separate fuel bowls and associated float-operated needle valves for maintaining the necessary fuel head in the system. One of these fuel bowls and associated float-operated needle valve assemblies controls the running fuel mixture. The other controls the starting mixture. As is well known, the fuel level in the float bowl varies during running conditions due to the inherent inability of the float-operated valve to stabilize its position. This presents no difficulty in connection with normal running of the engine since the opening of the float-operated valve will be compensated for by the consumption of fuel during normal running. In conjunction with the starting circuit, however, fluctuations will cause starting fuel to be consumed by the engine due to the inherent variations in the float position. With the previously proposed devices, the starting fuel flow is controlled between the float chamber and the point of introduction between this chamber and the induction system. Thus, even though the valve controlling the communication of starting fluid with the induction passage may be closed, excess starting fuel may be introduced into the induction passage or spilled from the venting arrangement during normal running, even though cold starting enrichment of this different fuel has been discontinued.

It is another object of this invention to provide an improved control arrangement for controlling the communication of starting fuel with the charge forming device during situations when cold starting enrichment using this other fuel is not required.

As has been noted in the foregoing description, multi-fuel engines require cold starting enrichment and the substitution of more ignitable fuels under certain low temperature conditions. In conjunction with such multi-fuel engines, it may be desirable to provide cold starting or cold running enrichment during intermediate temperatures which enrichment does not require the substitution of fuels. For instance, if the engine is operated on gasohol, or fuel mixtures which consist of a combination of gasoline and alcohol as aforedescribed, there are certain which which it is not necessary to substitute another fuel for starting. Nevertheless, it may be necessary to provide a enriched fuel-air mixture so as to facilitate starting and cold running during these intermediate temprature conditions. In the same regard, it may be necessary to provide a different starting fuel when the temperature falls below the aforedescribed intermediate range.

It is, therefore, a further object of this invention to provide an improved fuel feed arrangement for multi-fuel engines wherein different starting mixtures will be provided at different ambient temperatures.

It is yet a further object of this invention to provide a starting arrangement for a multi-fuel engine wherein enrichment of the fuel-air mixture based upon the normal running fuel is provided in certain temperature ranges and an enriched mixture of a different type of fuel is provided at other, lower temperatures.

SUMMARY OF THE INVENTION

A first feature of this invention is adapted to be embodied in a multi-fuel system for an internal combustion engine that has a first fuel source for normal engine running and a second fuel source for cold starting. Charge forming means supply a fuel-air charge to the engine. Cold start enrichment means provide cold starting enrichment from the charge forming means to the engine and the cold starting enrichment means is moveable between a first position and an enrichment position. Valve means moveable between an opened position and a closed position control the communication of the second fuel source with the charge forming means. In conjunction with this embodiment of the invention, means are provided for moving the valve means between its opened position and its closed position in response to the movement of the cold starting enrichment means from its enrichment position to its first position.

Another feature of the invention is adapted to be embodied in a multi-fuel system having first and second fuel sources and charge forming means as described in the preceding paragraph. In conjunction with this embodiment of the invention, the charge forming means includes a cold starting enrichment circuit for supplying an enriched fuel-air mixture to the engine. This enrichment means includes first valve means that is moveable from a closed position to a cold starting enrichment position for controlling the flow of enriched fuel-air mixture from the cold starting enrichment circuit. Second valve means selectively communicate the first fuel source with the cold starting enrichment circuit when the second valve means is in a first position and the second fuel source with the cold starting enrichment circuit when the second valve means is in a second position. Actuating means are provided which include an element that is moveable between first, second and third positions. Means are provided for selectively moving the first valve means from its closed position to its cold starting enrichment position when the element is moved from its first position to its second position and for retaining the second valve means in its second position when the actuating means is moved to its third position for providing cold starting enrichment when the actuating means is in either its second or third position. The actuating means is further operative to move the second valve means from its first position to its second position when the element is moved from the second position to the third position for providing enriched fuel-air mixture with the fuel being supplied from the second source.

DETAILED DESCRIPTION OF THE PREFERRED EMBODIMENTS

This invention is adapted to be embodied in a fuel feed system and associated charge forming device for an internal combustion engine embodying a multi-fuel system. Specifically, the invention is adapted to be embodied in conjunction with a fuel feed system for a motor vehicle in which a first fuel is employed for running the engine and propelling the vehicle under normal conditions. This first fuel may comprise either alcohol, a gasoline-alcohol mixture characterized by the name "gasohol," or other petroleum based fuels which afford a more efficient or more economical fuel for normal running. Many of these fuels, and particularly those which employ alcohol or a mixture of alcohol, afford certain disadvantages in connection with low temperature starting since they do not have sufficient characteristics at low temperatures to insure ignition for cold starting. Thus, it has been proposed to employ an additional fuel system that will introduce a more appropriate fuel such as pure gasoline or the like for starting. The embodiments of this invention are directed, as aforenoted, to such multi-fuel systems so as to insure adequate operation at all temperatures without excess consumption of the starting fuel.

Figure 1:
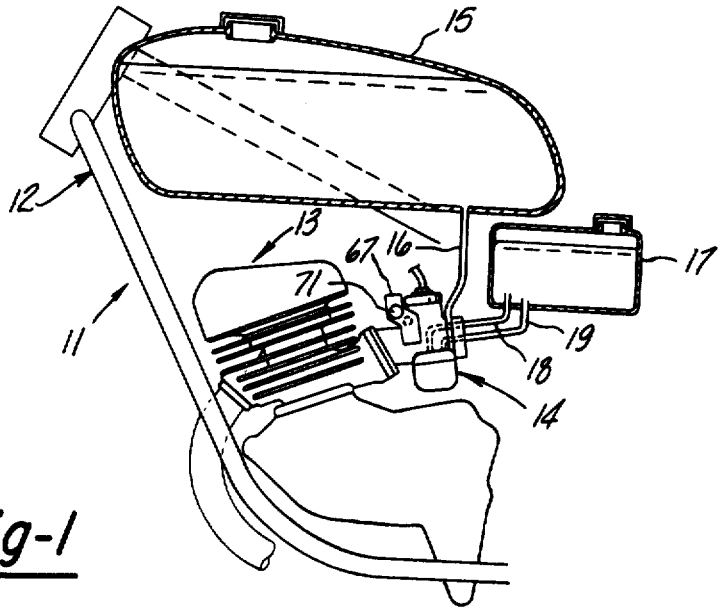
FIG. 1 is a partial side elevational view of a motor vehicle incorporating a dual fuel system in accordance with this invention.

In the embodiments disclosed, the invention is described in conjunction with a fuel feed system for a multi-fuel engine of a self-powered vehicle such as a motorcycle, which is identified generally by the reference numeral 11 in FIG. 1. The motorcycle 11 includes a frame assembly 12, which supports an engine, indicated generally by the reference numeral 13, which in turn drives the motorcycle 11 through a suitable transmission and drive (not shown). The engine 13 has a fuel system which includes a charge forming device in the form of a multi-fuel carburetor, indicated generally by the reference numeral 14, and shown in more detail in FIGS. 2 and 3, in connection with this embodiment and FIG. 4 in connection with the second embodiment. Except as hereinafter described, the engine 13 and carburetor 14 are conventional and for that reason only those features which are necessary to understand the embodiments of the invention will be described in detail.

The engine 13 and carburetor 14 are intended to operate on a multi-fuel system wherein a main fuel source 15, which contains alcohol or an alcohol-gasoline mixture (gasohol), or other similar petroleum based fuel, which supplies its fuel to the carburetor 14 by means of a conduit 16. The fuel provided by the source 15 is insufficient to permit good cold starting characteristics at low temperatures. A source of secondary or starting fuel, indicated generally by the reference numeral 17, is provided for these purposes. The volume of the starting fuel reservoir 17 is considerably smaller than that of the main tank 15. The secondary fuel reservoir 17 communicates with the carburetor 15 through a main conduit 18 and a reserve conduit 19 as will become more apparent as this discription proceeds.

Figure 2:
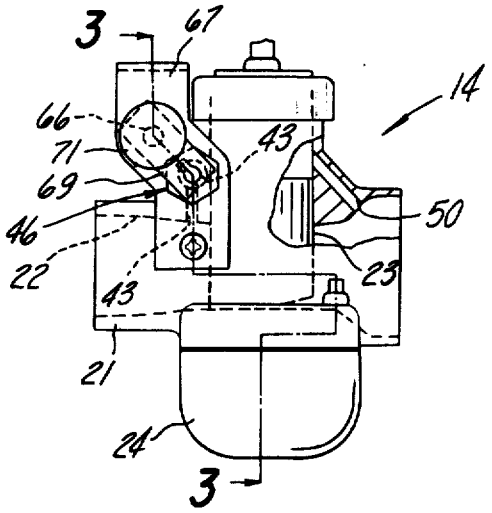
FIG. 2 is an enlarged side elevational view of the carburetor incorporated in the vehicle shown in FIG. 1.
Figure 3:
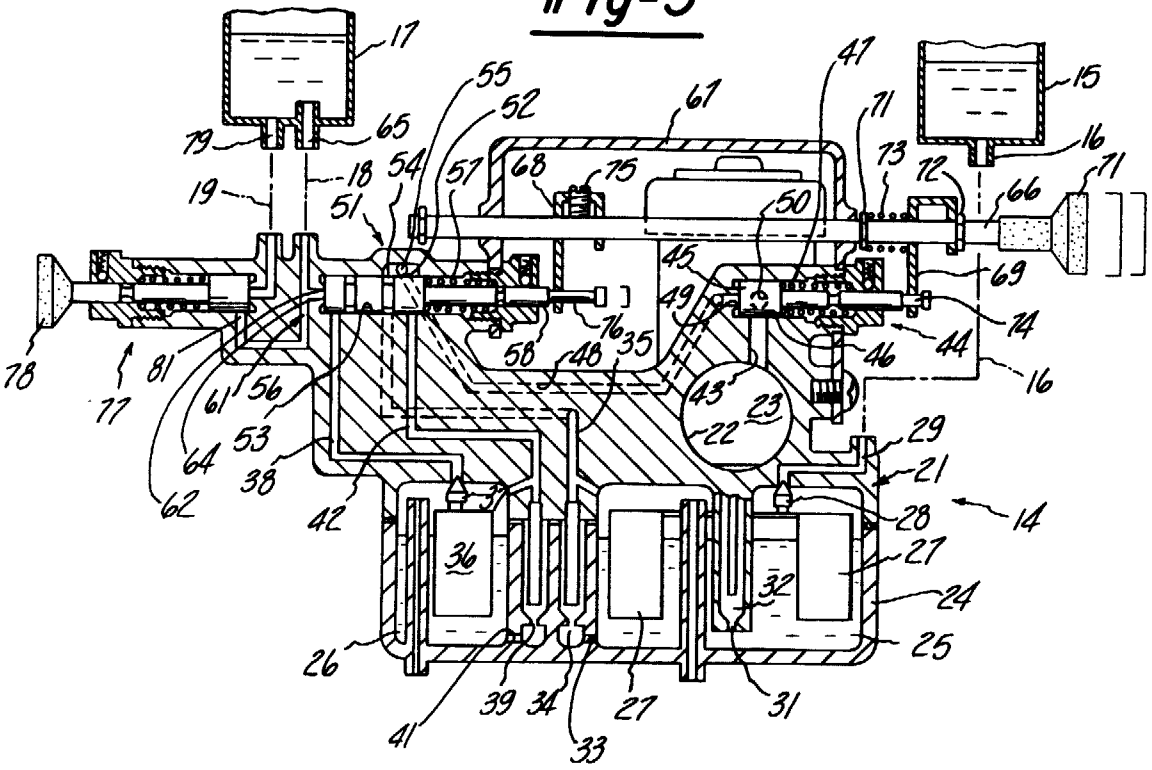
FIG. 3 is a still further enlarged cross-sectional view taken along the line 3—3 of FIG. 2.

Referring now primarily to FIGS. 2 and 3, the carburetor 14 includes a main body portion 21 that defines a main induction passage 22. A sliding piston 23 is supported in the main induction passage 22 and in connected to the operator-controlled throttle of the engine 13 so as to provide throttling of the engine 13 and control of the induction mixture so as to control the power and speed of the engine 13 as is well known.

The carburetor 14 is provided with a float bowl assembly indicated generally by the reference numeral 24, which defines a main fuel float chamber 25 and a starting fuel float chamber 26. The chambers 25 and 26 are isolated from each other, except as hereinafter described.

A main float 27 is supported in the main chamber 25 and operates a main needle valve 28 which controls the level of the normal running fuel supplied by the reservoir 15. In this regard, the main needle valve 28 controls the communication of the conduit 16 with the main fuel bowl portion 25 through a conduit 29. The fuel in the main fuel bowl portion 25 is normally fed to the engine 13 during conventional running at idle, transition and wide-open throttle through appropriate fuel and air conduits as is well known. These include a main fuel jet 31 which cooperates to control the flow to a main fuel well 32 that supplies fuel to the carburetor induction passage 22 in a known manner.

The main fuel bowl 25 also supplies a cold starting circuit, hereinafter being described, by means of a passage 33 which feeds a cold starting well 34 which, in turn, discharges into a cold starting fuel passage 35 for delivery to the carburetor main induction passage 22 in a manner to be described.

The starting fuel well 25 also is supplied with a uniform head of fuel which is controlled by a starting float 36 which, in turn, controls a needle valve 37 in a manner similar to the control of the main needle valve 28 by the float 27. The starting float chamber 26 is supplied with fuel from the starting fuel reservoir 17 by means including an inlet passage 38 which terminates at the seat with which the starting needle valve 37 cooperates.

The starting valve chamber 26 also serves the starting fuel circuit of the carburetor 14 in a manner to be described which includes a starting fuel well 39 which is fed from the starting fuel bowl 26 via a passage 41. The well 38 discharges into the starting circuit via a starting fuel discharge passage 42, as will be described.

The carburetor 14 includes a cold starting enrichment valve, indicated generally by the reference numeral 44, which controls the supply of an enriched fuel air mixture to the carburetor induction passage 22. As will become apparent, this enriched fuel air mixture can be supplied with either the main fuel from the reservoir 15 or the starting fuel from the reservoir 17. For this purpose, the carburetor body portion 21 is provided with a cold starting discharge passage 43. The flow through the passage 43 is controlled by the cold starting valve 44 which includes a spool 45 that is slideably supported in a bore 46 which is intersected by the passage 43. The starting valve spool 45 is normally urged to its closed position wherein the passage 43 is closed by means of a coil compression spring 47. A fuel passage 48 is formed in the carburetor body 21 and communicates fuel from either the sources 15 or 17 with the bore 46 via a port 49. The head of the spool 45, in addition to controlling the opening of the starting passage 43, controls the discharge of fuel from the port 49. Additional air is supplied to the starting enrichment system by a passage 50.

Which of the fuels from the reservoirs 15 or 17, are supplied to the starting passage 49, is controlled by a change-over valve, indicated generally by the reference numeral 51. The change-over valve 51 includes a valve spool 52 that is slideably supported in a bore 53 of the carburetor body 21. The spool 52 has a first circumferential relief 54 that is normally aligned with the intersection of the main fuel passage 35 with the bore 53. In this position, the relief 54 provides communication between the passage 35 and the starting fuel passage 48 which communicates with the bore 53 through an axially extending passage 55. A second circumferential relief 56 is provided on the valve spool 54 for selectively communicating the starting fuel passage 42 with the passage 55, as will become apparent as this description proceeds.

The change-over valve spool 52 is normally biased to a first position by means of a coil compression spring 57 which encircles the reduced diameter shaft portion 58 of the change-over valve spool.

The interior of starting fuel reservoir 17 communicates with the associated fuel bowl 26 through the conduit 18 and a secondary fuel passage 61 formed in the carburetor body 29. The secondary fuel passage 61 has a portion which extends axially to the change-over valve bore 53 to form a port 62. The communication of the port 62 with the bore 53 is controlled by a head 64 of the change-over valve 51. When the change-over valve 51 is in its opened position, as shifted to the right as seen in FIG. 3, the port 62 communicates with the bore 53 and the passage 38 so that fuel from the reservoir 17 may flow from a nipple or standpipe 65 through the passage 61 and bore 53 to the fuel bowl portion 26 through the passage 38, assuming the float 36 and its needle valve 37 is opened.

The starting circuit of the carburetor 14, which includes the change-over valve 51, is controlled by means of an actuator which includes a shaft 66 that is slideably supported within a coverplate 67 of the carburetor 13. A change-over valve actuating element 68 and a starting valve actuating element 69 are associated with the shaft 66 so as to be actuated upon movement of the shaft 66 in a manner now to be described. The shaft 66 has affixed to its outer end a control knob 71 which may be grasped by the operator of the vehicle and moved between a normal running position, as identified by the Roman numeral one (I), a first cold starting position, as identified by Roman numeral two (II), and a second cold starting position, as indicated by Roman numeral three (III).

In the normal running position (I) the cold starting valve 44 is held closed and the change-over valve 51 is held in its normal position as shown in FIG. 3 wherein the main fuel starting passage 35 communicates with the starting fuel passage 48 via the passage 54. When it is desired to provide cold starting enrichment but the temperature is not so low as to require fuel from the secondary fuel source 17, the cold starting control shaft 66 is moved to its first cold starting position (II). As will be described, under this circumstances the cold starting valve 44 is opened; however, the change-over valve 51 is still retained in the position shown in FIG. 3 so that the cold starting fuel will be supplied from the fuel bowl 25 and main fuel tank 15. At lower ambient temperatures, the knob 71 is pulled to the second cold start position (III) and the cold starting valve 44 is maintained in its open position. The change-over valve 51 is then shifted to the right so that the port 64 will be opened to permit the secondary fuel to flow from the reservoir 17 into the float bowl 26. In addition, the recess 56 opens communication with the secondary fuel passage 42 and the starting fuel passage 48 so that cold starting will be supplied from the secondary fuel source.

To achieve the aforenoted sequence of operation, the cold starting valve actuator element 69 is slideable supported on the shaft 66 between a pair of washers 71 and 72 that are suitably affixed to the shaft 66 and precluded from axial movement. A coil compressing spring 73 acts between the washer 71 and the depending arm of the element 69 so as to urge it to the right against the washer 72. The depending arm 69 is bifurcated and is received in a circumferential recess 74 formed in a projecting end of the cold starting valve element spool 47. Thus, when the knob 71 is moved to the right from its normal running position (I) to its first cold starting position (II), the element 69 will follow the movement of the shaft 66 and move the cold starting valve element 45 from its closed position to its opened, cold starting position. Upon continued movement of the knob 71 to its second cold starting position (III), the spring 73 will yield so that the shaft 66 may continue to move to the right without effecting further movement of the cold starting valve 44.

The change-over valve actuating element 68 is also of a generally "L" shape and is adjustably fixed to the shaft 66 by means of a set screw 75. The depending arm of the element 68 is bifurcated and is received in an elongated recess 76 formed in the projecting end 58 of the change-over valve element. The length of the recess 76 in the axial direction is such that movement of the shaft 66 from its normal running position (I) to its first cold starting position (II) will merely cause the element 68 to traverse the length of the recess 76. Upon continued movement of the knob 71 and shaft 66 to the second cold starting position (III), the change-over valve element 52 will be shifted to the right so as to open the port 64 and bring the recess 56 into communication with the secondary fuel passage 35 so that cold starting enrichment will be provided from the secondary fuel source 17.

Upon return of the cold starting knob 71 from its second cold starting position (III) to its first starting position (II), the change-over valve 51 will be moved back to the position shown in FIG. 3 by the action of the spring 57 upon the valve element 52. Thus, the flow of fuel from the secondary fuel source 16 into the cold starting system will be stopped by the closure of the passage 64 and the secondary fuel will not be depleted. Continued enrichment will be provided as long as the knob 71 is in its first cold start position (II) by the main fuel circuit through the still open cold starting valve 44. During this degree of movement of the shaft 66, the compression of the spring 73 will be relieved and the cold starting valve actuating element 69 will again be brought into contact with the washer 72. When the knob 71 is moved to its normal running position (I), the cold start valve 44 will again be moved to its closed position due to contact between the washer 72 and the actuating element 69.

As has been noted, the described system prevents the depletion of the secondary fuel from the reservoir 17 by insuring against communication of the fuel from the secondary reservoir 17 with the secondary fuel bowl 26. By closing off the communication of the secondary fuel with the fuel bowl 26 and more specifically with the needle valve 37, it will be insured that the starting fuel will now be needlessly consumed. Even if the change-over valve insured against communication of the secondary fuel bowl 26 with the starting circuit of the carburetor, the vibrations of the vehicle might cause the needle valve 37 to alternately open and close and result in excess fuel in the bowl 26 which would pass out of either the overflow or by otherwise wasted. This problem is not prevelent with the fuel bowl 25 since when the engine is running fuel is continuously consumed from this bowl.

Because the communication of the starting fluid reservoir 17 with the fuel bowl 26 is terminated, the portion of the change-over valve 51 which controls the communication with either of the fuel bowls 25 or 26 with the starting circuit enrichment passage 48 may be dispensed with. In this event, however, there will be some depletion of secondary fuel since the fuel bowl 26 may be drained of this fuel during the continued warm-up of the engine when the knob 71 is in its first cold start position (II).

As has been previously noted, the conduit 18 is fed with fuel from the secondary fuel reservoir 17 via a standpipe 54 that extends above the lower wall of the reservoir 17. This, in effect, provides a safety reservoir for starting fuel and still further insured against the likelihood of the operator being stranded without a source of starting fuel at low temperatures. If the fuel from the reservoir has been depleted down to the opening of the standpipe 54, the reservoir of the secondary fuel below the upper end of the standpipe 54 may be employed by actuating a reservoir valve 77 which is also positioned in the carburetor body 21. The valve 77 is actuated by a knob 78 and opens communication with the conduit 19 which is in turn fed from a nipple 79 formed in the lower wall of the reservoir 17. When the valve 77 is opened, the reservoir fuel may flow through a passage 81 into the port 62 to supply the secondary fuel bowl 26.

It should be readily apparent that the described embodiment is highly effective in permitting cold starting at extremely low temperatures through the use of a starting fuel and that unnecessary depletion of this fuel source is precluded by closure of communication of the fuel source with the secondary fuel bowl of the carburetor when the cold starting control is moved to a normal cold start position.

Figure 4:
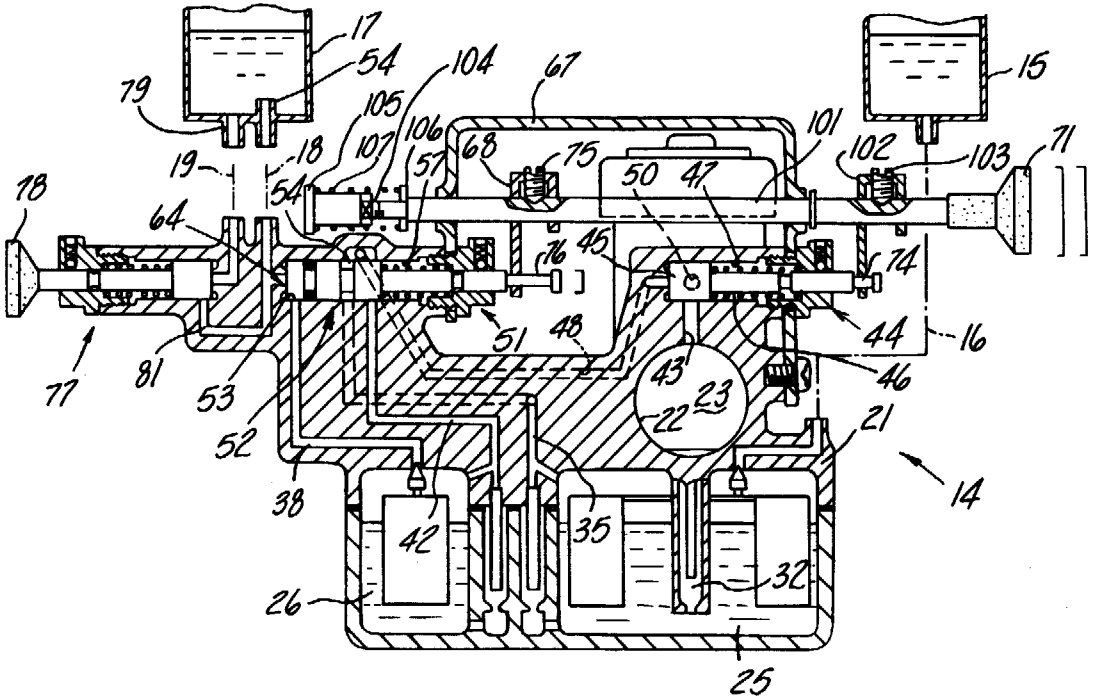
FIG. 4 is an enlarged cross-sectional view, in part similar to FIG. 3, showing a further embodiment of this invention.

The effectiveness of this system can still further be improved if an arrangement is provided with automatic return of the cold starting control to its normal or first cold starting position when the operator releases the knob 71. Such an embodiment is shown in FIG. 4. In many regards this embodiment is the same as the embodiments of FIGS. 1 through 3 and for that reason only the cross-sectional view corresponding to FIG. 3 has been illustrated. In addition, components which have substantially the same construction and operation as in the previously described embodiment will not be described again and these parts have been identified by the same reference numerals as in the previously described embodiment.

In conjunction with this embodiment, the knob 71 is connected to a cold starting valve and change-over valve control shaft 101 which is, as in the previously described embodiment, slideably supported within the carburetor cover 67. In conjunction with this embodiment, a cold starting valve actuator element 102 is adjustably affixed to the shaft 101 by means of a set screw 103. The cold starting actuator element 102 has a generally "L" shape as in the previously described embodiment and a bifurcated arm is received in a circumferential groove 74 of the cold starting enrichment valve element 45. In conjunction with this embodiment, the cold starting enrichment valve element continues to move with the knob 71 as the knob 71 and associated shaft 101 are moved from their first cold starting enrichment position (II) to their second cold starting enrichment position (III). This continued movement has no significant effect and is achieved by elongating the bore 46 in which the element 45 is supported.

As in the previously described embodiment, a change-over valve actuating element 68 is affixed to the shaft 101 by means of a set screw 75 and cooperates with a elongated recess 76 of the change-over valve element 52. As was also true in the preceding embodiment, when the knob 71 and shaft 101 moves from the normal running position (I) to the first cold starting position (II), the bifurcated arm of the change-over actuating element 68 merely transverses the length of the recess 76. Continued movement is effective to cause the change-over valve 51 to open the communication of the secondary fuel reservoir 17 with the float bowl 26 as the knob 71 is moved from its first cold starting position to its second cold starting position.

In this embodiment, the portion of the shaft 101 which extends to the left of the carburetor cover 67 is provided with a reduced portion 104 that is threaded at its outer end and which adjustably received a stop 105. A washer 106 is engaged with the shoulder formed in the base of the reduced diameter portion 104 and a compression spring 107 is loaded between the stop 105 and the washer 106. The arrangement is such that when the knob 71 is moved to its first cold starting position (II) the washer 106 will engage the cover 67. Upon further movement of the knob 71 and shaft 101 to their second cold starting position (III), the spring 107 will be compressed. Immediately upon release of the knob 71, the spring 107 will move the knob 71 and the shaft 101 to their first cold starting position (II). The change-over valve 51 will, therefore, be immediately closed so as to prevent communication of the reservoir 17 with the float bowl 26 and to immediately stop the flow of the secondary starting fuel. Thus, this embodiment has all of the advantages of the preceding embodiment and further insures that the flow of the starting fuel will be immediately stopped automatically once the knob 71 is released by the operator. Thus, the likelihood of inadvertant retention of the cold starting enrichment system in its second position is precluded.

It should be understood from the foregoing description that two embodiments of the invention have been disclosed, each of which insures against unwanted usage of the starting fuel through closing of a valve that communicates the starting fuel reservoir with its associated fuel bowl when cold start enrichment using the cold starting fuel is no longer required. Furthermore, in one of these embodiments this is achieved automatically. In addition, an arrangement is provided wherein the secondary fuel source may be automatically selected during certain cold starting operations. Various changes and modifications may be made without departing from the spirit and scope of the invention as defined by the appended claims.

We claim:

1. A multi-fuel system for an internal combustion engine having a first source of fuel for normal engine running, a second fuel source for cold starting, charge forming means for supplying a fuel air charge to the engine, cold starting enrichment means for providing cold starting enrichment from said charge forming means to the engine, and valve means moveable between an opened position and a closed position for controlling the communication between said second fuel source and said cold starting enrichment means, the improvement comprising said cold start enrichment means having a normal position, a first position and an enrichment position, means for moving said valve means between its opened position and its closed position in response to movement of said cold starting enrichment means from its enrichment position to its first position and for maintaining said valve means in its closed position when said cold start enrichment means is in its normal position, and change-over valve means selectively communicating said second fuel source with said cold starting enrichment means when said change-over valve means is in a first position or said first fuel source with said cold starting enrichment means when said change-over valve means is in a second position.

2. A multi-fuel system as set forth in claim 1 further including means for biasing the cold starting enrichment means to its first position for closure of the valve means upon release of the cold starting enrichment means.

3. A multi-fuel system as set forth in claim 1 wherein the means for moving the valve means is also effective to move the change-over valve means from its second position when the cold starting enrichment means is in its first position and its first position when the cold start enrichment means is in its enrichment position for providing selective enrichment from either of the fuel sources.

4. A multi-fuel system as set forth in claim 3 further including biasing means for biasing the cold starting enrichment means from its enrichment position to its first position, the valve means from its opened position to its closed position and the change-over means from its first position to its second position.

5. A multi-fuel system as set forth in either of claims 1 or 4 wherein the charge forming means comprises a carburetor having a first fuel bowl and a second fuel bowl, the first fuel source being effective to feed said first fuel bowl and the second fuel source being adapted to feed the second fuel bowl.

6. A multi-fuel system as set forth in claim 5 further including a float operated needle valve means in each of the fuel bowls for controlling the level of fuel therein.

7. A multi-fuel system as set forth in claim 6 wherein valve means is interposed between the second fuel source and the needle valve of the second fuel bowl.

8. A multi-fuel system for an internal combustion engine having a first fuel source of fuel for normal engine running, a second fuel source of fuel for cold starting, charge forming means for supplying a fuel air mixture to the engine, said charge forming means including a cold starting enrichment circuit for supplying an enriched fuel air mixture to the engine, first valve means in said cold starting enrichment circuit moveable from a closed position to a cold starting enrichment position for controlling the flow of enriched fuel air mixture from said cold starting enrichment circuit, second valve means for selectively communicating said first fuel source with said cold starting enrichment circuit when said second valve means is in a first position and said second fuel source with said cold starting enrichment circuit when said second valve means is in a second position, and actuating means including an element moveable between first, second and third positions, said actuating means being operative for selectively moving said first valve means from its closed position to its cold starting enrichment position upon movement of said element from its first to its second and third positions and for moving said second valve means from a first position when said element is in its second position to the second position of said second valve means when said element is in its third position for providing cold starting enrichment from the first fuel source when the element is in its second position and cold starting enrichment from the second fuel source when the element is in its third position.

9. A multi-fuel system as set forth in claim 8 wherein the charge forming means comprises a carburetor, a first fuel bowl and a second fuel bowl, each of said fuel bowls having a discharge circuit in communication with the second valve means, first conduit means connecting said first fuel source with said first fuel bowl, and second conduit means connecting the second fuel source with said second fuel bowl.

10. A multi-fuel system as set forth in claim 9 further including first and second float operated valve means in the first and second fuel bowls for controlling the level of fuel therein.

11. A multi-fuel system as set forth in claim 10 further including shut off valve means in the second conduit for closing communication of the second fuel source with the second fuel bowl.

* * * * *